United States Patent [19]

Restivo

[11] Patent Number: 4,841,592

[45] Date of Patent: Jun. 27, 1989

[54] FAN BLADE CLEANING TOOL

[75] Inventor: David J. Restivo, Orange Park, Fla.

[73] Assignee: E.C.V. Company, Jacksonville, Fla.

[21] Appl. No.: 942,677

[22] Filed: Dec. 17, 1986

[51] Int. Cl.[4] ..... A47L 13/38; A47L 13/42; B25G 3/30

[52] U.S. Cl. ..... 15/210 R; 15/145; 15/244.1

[58] Field of Search..... 15/210 R, 210 A, 210 B, 15/244 R, 160, 244.1, 244.3, 214, 145, 218.1, 104.04; D32/40, 51, 52

[56] References Cited

U.S. PATENT DOCUMENTS

| | | | |
|---|---|---|---|
| 2,113,235 | 4/1938 | Likens | 15/210 B |
| 2,599,420 | 6/1952 | Westhoff | 15/210 A |
| 2,719,313 | 10/1955 | Smith | 15/210 B |
| 2,817,867 | 12/1957 | Bugbird | 15/145 X |
| 2,819,484 | 1/1958 | Fouse | 15/210 A |
| 2,856,625 | 10/1958 | Delacretaz | 15/210 A |
| 3,520,018 | 7/1970 | Zaidan | 15/210 A |
| 3,686,702 | 8/2972 | Jordan | 15/210 B |
| 4,157,598 | 6/1979 | Talent et al. | 15/145 |
| 4,380,841 | 4/1983 | Thomas | 15/210 B |
| 4,480,352 | 11/1984 | Eggett | 15/214 |

FOREIGN PATENT DOCUMENTS

| | | | |
|---|---|---|---|
| 1402358 | 8/1975 | United Kingdom | 15/210 A |

*Primary Examiner*—Harvey C. Hornsby
*Assistant Examiner*—Scott J. Haugland

[57] ABSTRACT

The tool includes a hollow housing, a cleaning element removably mounted in the housing and a handle threadably attached to the housing. The cleaning element is formed of a deformably resilient sponge material and has a centrally disposed passageway aligned to frictionally engage outer surfaces of a fan blade. The passageway extends from an inlet end to an exit end with the inlet end being vertically and horizontally tapered from a wide open front to an interior portion in which the vertical tapering is terminated and thence tapered only in the horizontal direction to its exit end. The surfaces defining the passageway are covered by a material having fiber protruding therefrom for gently cleaning and capturing the debris when the blade is passed through the passageway. The handle on the device is angled to compensate for the angle of the blade to allow the user to clean a fan blade with the handle pointing generally vertically from an overhead fan.

26 Claims, 2 Drawing Sheets

FAN BLADE CLEANING TOOL

RELATED APPLICATION

This application relates to my U.S. Pat. No. Des. 296,022, granted May 31, 1988.

BACKGROUND OF THE INVENTION

1. Field of the Invention

The present invention pertains to the field of cleaning apparatus and particularly to a device used to clean fan blades, especially blades of ceiling fans, and polishing same.

2. PRIOR ART

There are a wide variety of devices known to the prior art that are used to clean fans and fan blades. The devices are variations of dusters and are used to clean the blade or by simply wiping it with a cloth or sponge. The principal difficulty with using such devices is the fact that the fan blades rotate when subjected to any lateral force. In addition, some of the debris is very often simply knocked loose by most cleaning devices rather than adhering to the cleaning material used.

Fan blade cleaning devices must also accommodate the shape of the blade. This is especially important with ceiling fans where the outer end of the fan blade is wider than the inner end which is connected to the fan rotor. Furthermore, the cleaning device must be easy to use with an overhead fan. None of the devices in the prior art are satisfactory for fast and thorough cleaning of ceiling fan blades.

SUMMARY OF THE INVENTION

In accord with the invention a fan blade cleaning tool is provided which includes a cleaning element removably mounted within a housing, the element having interior surfaces defining a centrally disposed passageway aligned to frictionally engage an outer surface of a fan blade for removing debris therefrom. An elongated handle is affixed to the housing for moving the cleaning element over the length of a fan blade to substantially clean the entire fan blade. Preferably the element is formed from a deformably resilient material with the passageway extending from an inlet end portion to an exit end portion. The inlet end portion is vertically and horizontally tapered from a wide open inlet end to an interior in which the vertical tapering terminates, and the passageway thereafter is tapered only in the horizontal direction to its exit end portion. The passageway also has a decreasing transverse width from its inlet to its exit. Other aspects include the provision of an improved cleaning tool wherein the passageway includes an inlet defined by a pair of oppositely disposed and facing trapezoidal surfaces with a first surface declined rearwardly from a horizontal plane and a second surface inclined rearwardly from a horizontal plane, and a pair of oppositely disposed trapezoidal upright walls connected longitudinally along their respective upper and lower edges to the trapezoidal surfaces. A material having fibers protruding therefrom is affixed to the internal surfaces defining the passageway for gently cleaning and capturing the debris when the cleaning element engages and is passed longitudinally of a fan blade.

Additional aspects are seen to features that the housing has top, bottom and a pair of spaced side walls defining a hollow shell with an open front and open back defined by substantially continuous shoulders directed inwardly from said top and bottom walls for containing and securing the cleaning element therein. The cleaning element is formed of a material having sufficient resiliency to allow the element to be compressed and loaded in the housing through the open front or back and remain secured therein due to expansion thereof to substantially fill the housing with the shoulders engaging the cleaning element.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the drawings in which:

DETAILED DESCRIPTION OF THE PREFERRED EMBODIMENTS

Figure 1:
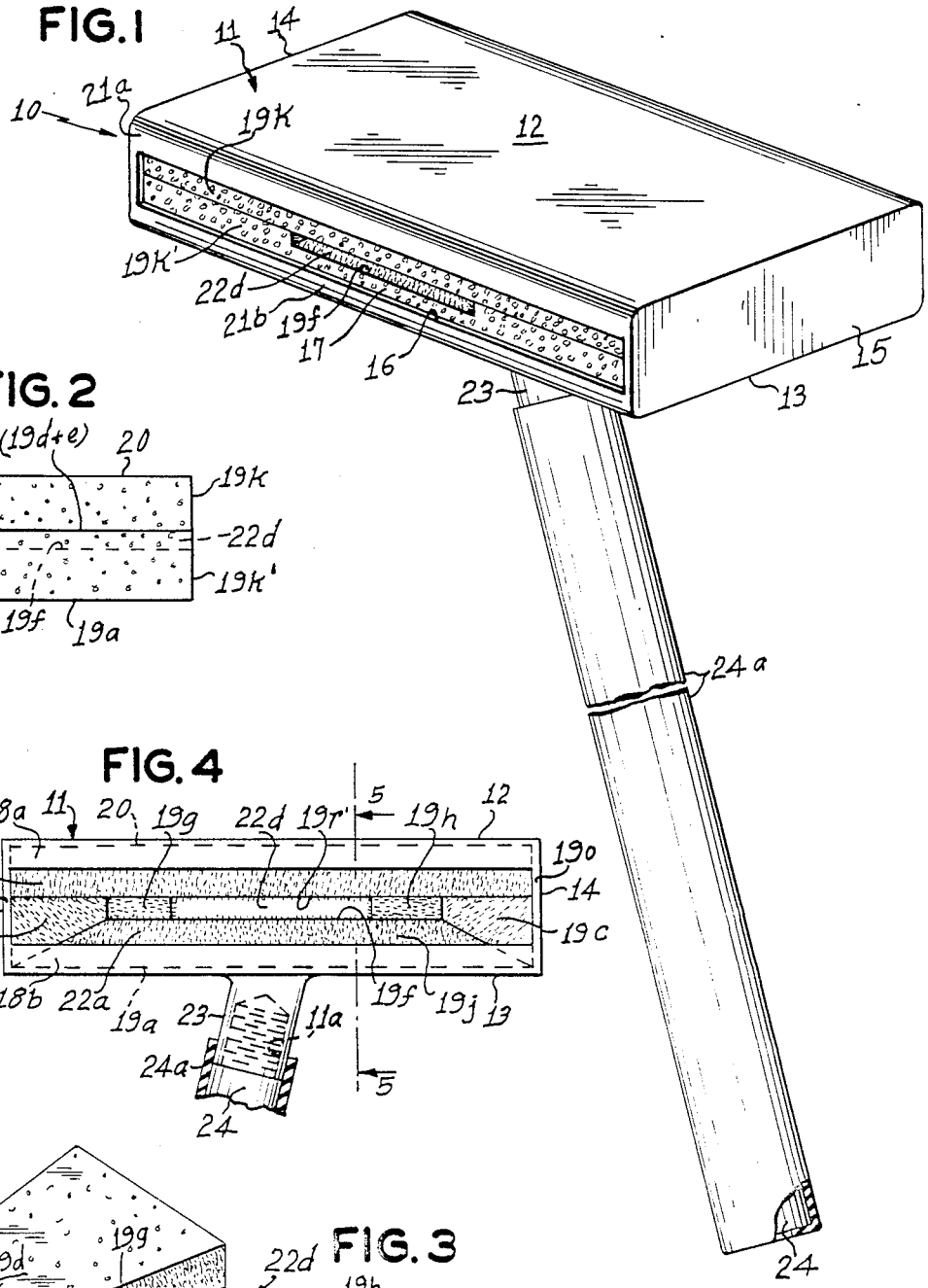
FIG. 1 is a rear perspective view of the fan blade cleaning tool in accordance with the present invention.
Figure 6:
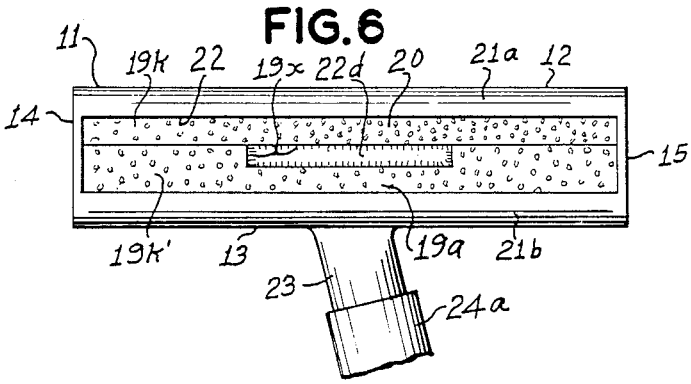
FIG. 6 is a rear elevational view of the tool of FIG. 1.

Referring now to FIG. 1, the fan blade cleaning tool is shown generally at 10 and comprises a housing 11 in the form of a hollow shell with top 12 being parallel to bottom 13, and parallel side walls 14, 15. The housing 11 is formed with a front wall 17 having an opening 16 defined by integrally-formed, inwardly-directed flanges 18*a* and 18*b* which function as a front restrainer or retainer for cleaning element 19 as will be more apparent hereinafter. The rear face 21 of housing 11 (see FIG. 6) has an opening 22 defined by inwardly-directed flanges 21*a* and 21*b* which also operates as a rear retainer for cleaning element 19. Thus, the hollow shell of the housing 11 is enclosed except for the front opening 16 (FIG. 1) of the front wall 17 and the rear opening 22 (FIG. 6) in rear face 21.

Figure 2:
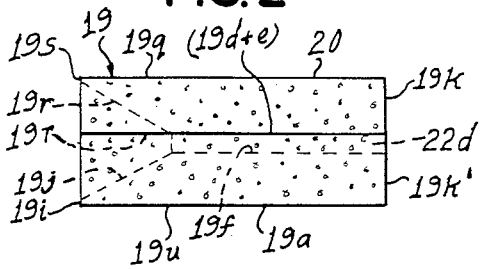
FIG. 2 is a side elevational view of upper and lower portions of the cleaning element used in the present invention.
Figure 3:
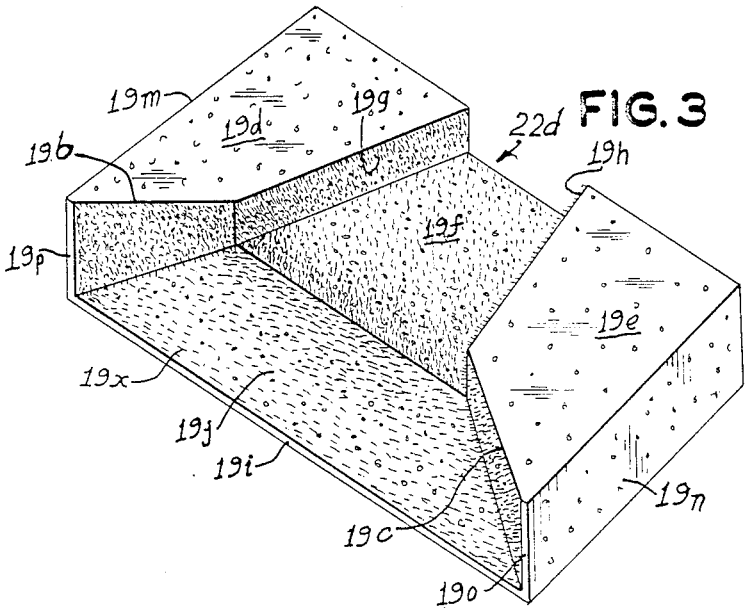
FIG. 3 is a perspective view of the lower portion of the cleaning element.
Figure 5:
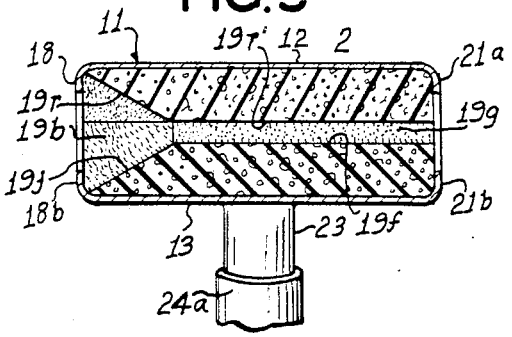
FIG. 5 is a cross sectional view taken along line 5—5 of FIG. 1.

The cleaning element 19, removed from the housing 11, is best illustrated in FIGS. 2 and 3, with the upper portion 20 spaced away from the lower portion 19*a* in FIG. 2 and removed in FIG. 3. The lower portion 19*a* of cleaning element 19 is made of a deformably resilient material such as an imitation foamed material or sponge and is cut or molded to form inwardly-directed surfaces 19*b* and 19*c* and upper flat surfaces 19*d* and 19*e*. Side walls 19g and 19h are formed by removing a block or section of the material to leave a channel bottom 19f and intersecting side walls 19g and 19h. Front engaging surface 19i fits against the inside surface of flange 18b. An inclined or beveled surface 19j is formed between front surface 19i and inwardly or tapering surfaces 19b, 19c and channel bottom 19f. Upstanding surfaces 19o and 19p are rounded or flat so that the material is not sharp as is well known in the art. The lower flat surface 19u rests against the inner surface of housing bottom 13 and the sides 19m and 19n respectively engage housing sides 15 and 14. The upper portion 20 of cleaning element 19 is a generally rectangular piece of sponge of generally uniform thickness cut to be complemental to the length and width of lower portion 19a and having an inwardly-directed declined or beveled surface 19r. A removable fleece type of sleeve may be slipped over each of the sponge upper and lower portions 19a and 20 to provide a good cleaning surface to pick off and retain debris from the fan blades. If the fleeced material is glued or deposited onto the sponge material, the upper portion 20 and lower portion 19a are held in position by the compressive forces that result from the portions 19a and 20 being slightly oversize with respect to the interior space of the housing 11. Thus a passageway 22a is formed having inlet opening 22b, defined by two generally trapezoidal surfaces 19j and 19m joined rearwardly along their edges with generally trapezoidal inwardly-directed surfaces 19b and 19c; and a tapering portion 22c defined by walls 19g, 19h, bottom 19f and top 19r', the central portion of surface 19r that is not glued to or forced into contact with surfaces 19d and 19e and exit opening 22d. The tapering portion 22c of passageway 22a is formed contiguous with the rear perimeter of the inlet defined by surfaces 19j, 19r, 19b and 19c. In the preferred embodiment of the invention, walls 19g and 19h are formed to be inwardly tapered or directed a slight distance throughout their rearward extend as best seen in FIG. 3. The rear surfaces 19k, and 19k' upper portion 20 and lower portion 19a respectively, are cut vertically and rest against the rear flanges 21a and 21b. When the cleaning element 19 is fabricated it can be installed in housing 11 by simply compressing the sponge material through front or rear openings 16 and 22, respectively, and positioning same with the upper surface 19q and bottom surface 19u flush with the internal top and walls of housing 11 and with the inlet opening 22b juxtaposed to the front wall formed by spaced flanges 18a and 18b.

In the preferred embodiment of the cleaning tool 10, the surfaces 19j, 19r; 19b, 19c; 19g, 19h, 19f and 19r' that define the passageway 22a are covered with an acrylic fiber 19x which may be glued or otherwise deposited in place. The acrylic fiber 19x aids in the cleaning process by removing and trapping dirt and debris from a fan blade.

Figure 4:
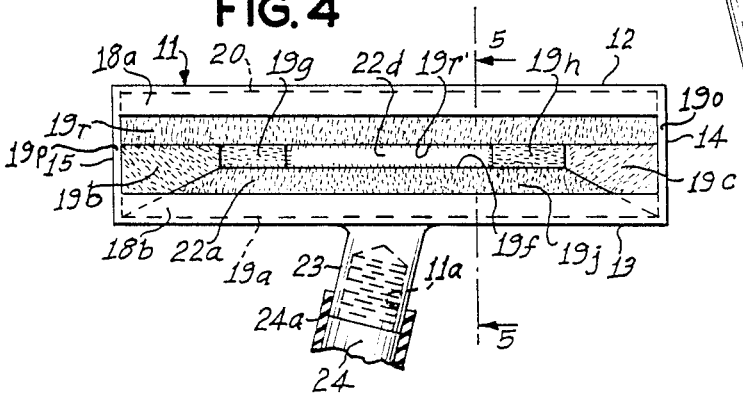
FIG. 4 is a front elevational view of the tool of FIG. 1.

Referring now to FIG. 4, the arrangement of the fiber clad surfaces of passageway 22a are shown in a manner which facilitates a description of the operation of the cleaning tool 10. Handle fitting 23 is an integrally formed part of housing 11 and has integrally molded threads 11a into which is secured a handle 24. The handle 24 preferably includes a rubberized sleeve 24a substantially covering the entire handle 24 to provide a more secure grip and greater comfort for a user. The handle fitting 23 is angled so that a person using the fan blade cleaning tool 10 may easily operate the tool 10 which compensates for the blade angle and permits the user to grasp the generally vertical handle 24, with the user's shoulders generally laterally of the blade being cleaned and pass the tool through its back and forth cleaning stroke. Also, this arrangement allows for better visibility by a user and prevents any debris knocked loose from the fan blade in either direction from falling directly onto the user during use thereof.

The passageway 22a is sized to accommodate various blade thicknesses and widths without causing significant damage to the sponge material and/or the fiber covering 9x. The cleaning element 19 is removable so that new fleece sleeves can be employed on the same sponge materials (assuming no glue or the like), and the cleaning element 19 can be easily removed for cleaning or replacement when it becomes too worn for proper cleaning.

The surfaces 19b, 19c and 19j, 19r are angularly disposed along the longitudinal axis of the cleaning tool 10 so as to engage the outer rounded edge of a fan blade and remove debris which is forced into the fiber covering material 19x and not simply pushed off the blade and onto the floor below.

The surfaces 19g and 19h are also angularly disposed inwardly along the longitudinal axis to engage the longitudinal edges of a fan blade. Generally, a fan blade has greater transverse width as its length increases outwardly from the connection to the fan rotor. The deformably resilient sponge material used in the cleaning element 19 allows the wider section of the fan blade to be forced through the inlet 22a of passageway and thence through the narrowed exit 22d. The channel walls 19g and 19h are spaced closer than the narrower, inward portions of the fan blade and will effectively clean them.

The front face opening 16 and rear face opening 22 have sufficient width to accommodate a wide variety of fan blade widths and have sufficient height to allow for a wide variety of fan blade thicknesses and to allow for travel of the cleaning tool 10 over the fan blade-to-rotor connection means such as a bolted clamshell-like apparatus that is frequently employed. However, if the bolts used are longer than the dimension of the two clamshells and the blade, one of the flanges 18a or 18b will engage the bolt and not permit the tool to be drawn over the exposed bolt end which would damage the material of element 19.

In the preferred embodiment of the present invention the surfaces 19j and 19r are vertically inclined and declined 45°, respectively, with regard to the horizontal plane of the housing bottom 13 and top 12, respectively, to provide an ease of entrance for the blade and engaging faces for the outer edge of a fan blade. Similarly, surfaces 19b and 19c are convergent at about 30° angles measured from the plane of the front face 17 to provide an ease of entrance and a sharp angle of contact with the blade surface.

Figure 7:
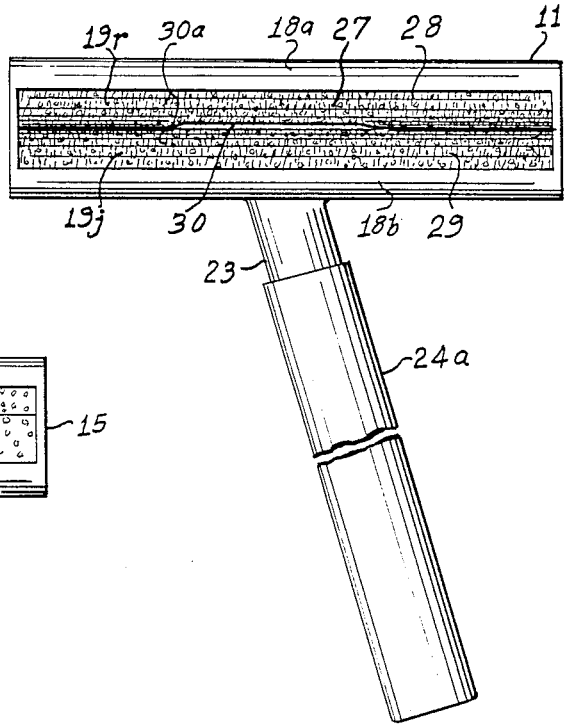
FIG. 7 is a front elevational view of another embodiment of the present invention.
Figure 8:
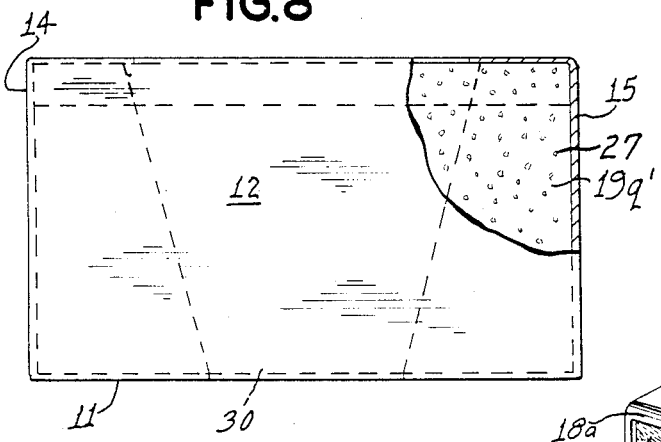
FIG. 8 is a top plan view of another embodiment of the cleaning tool with a portion of the housing broken away to show the upper surface of the cleaning element.

Another embodiment of the invention is illustrated in FIGS. 7 and 8 and all components thereof that are identical are marked with the corresponding numeral. A modified cleaning element 27 comprises two sections 28 and 29 with acrylic fibers 30a on the upper planar surface of section 29 and the lower planar surface of section 28. The cleaning elements 28 and 29 also employ a deformably resilient material such as sponge as described heretobefore with upper surface 19g' in compressed contact with top wall 12. The passageway 30 (shown enlarged in FIG. 8) is formed by similar tapered upper and lower walls 19r and 19j with the upper portion 28 and lower portion 29 being identical and one turned over so that the tapered walls 19*r* and 19*j* are in alignment. This cleaning element 27 may be more acceptable in that it is simpler and cheaper to manufacture than the preferred embodiment of the element described hereinabove but does not provide an effective means for cleaning the blade edges as does the preferred embodiment through the use of channel walls 19*g* and 19*h* and angled surfaces 19*b*, 19*c*, 19*j* and 19*r*.

Figure 9:
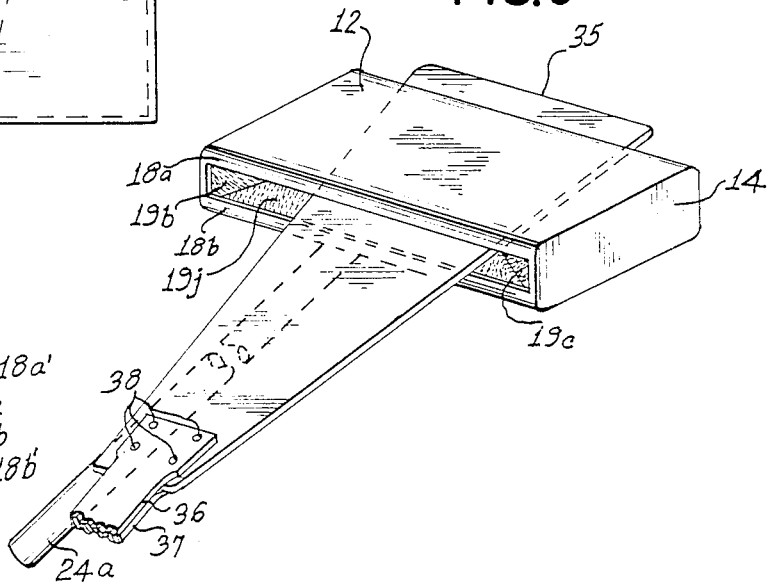
FIG. 9 is a perspective view of the cleaning tool of the invention as it might appear during the cleaning of a fan blade.

FIG. 9 illustrates the position of a fan blade 35 as it might appear during the cleaning process. Blade 35 is connected to the fan rotor (not shown) by way of clamshell brackets 36, 37 which are secured to the blade 35 usually by four bolts 38.

Figure 9A:
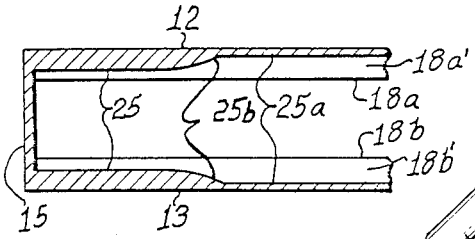
FIG. 9*a* is a partial cross-sectional view of another embodiment of the present invention.

FIG. 9*a* illustrates an alternate embodiment of the invention wherein housing 11 includes shoulders 25 integrally molded as a thicker part of top 12 and bottom 13 to provide greater compressive forces against the cleaning element 27 when it is placed within the housing 11. The shoulders 25 are tapered, in the same manner as generally illustrated in FIG. 8, from the front wall 21*a* toward the back wall 21*b* and have free edges 25*b* which merge with the interior of the respective top and bottom walls 12, 13. As seen, the compressive forces are aligned in superposition with the exterior surfaces of the cleaning element 27 when the same is placed in the housing 11. The vertical thickness of the substantially flat shoulders 25*a* is less than the vertical distance of the inwardly directed flanges 18*a* and 18*b* on the front wall 21*a* (and 21*b* on the back wall), whose interror surfaces are shown at 18*a*′ and 18*b*′ respectively. This embodiment, while generally not providing superior fan blade edge cleaning as the FIGS. 1–6 embodiment, provides more than adequate fan blade edge clean than the embodiment shown in FIGS. 7 and 8.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A fan blade cleaning tool comprising an enclosed housing having an open entrance and an open exit with said entrance and exit being in longitudinal alignment, a cleaning element removably mounted in said housing, said element having at least a pair of generally planar interior surfaces defining a centrally disposed passageway aligned to simultaneously and frictionally engage outer surfaces and both elongated side edges of a fan blade for removing debris therefrom, a handle affixed to said housing for moving said cleaning element over the length of the fan blade whereby substantially the entire fan blade is cleaned by a single reciprocating pass longitudinally onto and off the fan blade, said housing including a top wall, a bottom wall, a pair of spaced side walls and an open front and back wall defining a hollow closed shell, said cleaning element being under compression between said top and bottom walls, said top and bottom walls having substantially continuous shoulders directed inwardly along the length of said side walls to provide greater compression forces against said cleaning element along said shoulders than compressive forces on said cleaning element by said top and bottom walls engaged by said cleaning element whereby edges of the fan blade are cleaned while simultaneously cleaning a top and bottom surface of the fan blade.

2. The fan blade cleaning tool as in claim 1 wherein said shoulders are tapered generally inwardly from said front wall towards said back wall.

3. The fan blade cleaning tool as in claim 2 wherein said shoulders are substantially flat a predetermined distance from respective said side walls and terminate in smooth reduced edges merging with respective said top and bottom walls.

4. A fan blade cleaning tool comprising an enclosed housing having an open entrance and an open exit with said entrance and said exit being in longitudinal alignment, a cleaning element removably secured within said housing, said element having at least a pair of generally horizontally disposed planar surfaces substantially in superposition to simultaneously and frictionally engage the outer surfaces and both elongated side edges of a fan blade for removing debris therefrom, a handle affixed to said housing for moving the cleaning element over the length of the fan blade whereby substantially the entire fan blade is cleaned by a single reciprocating pass longitudinally onto and off the fan blade, said housing including a top wall, a bottom wall, a pair of spaced side walls in open front and back wall defining a hollow closed shell, said cleaning element being under compression between said top and bottom walls, said top and bottom walls having substantially continuous shoulders directed inwardly along the length of said side walls to provide greater compression forces against said cleaning element along said shoulders than compressive forces on said cleaning element by said top and bottom walls engaged by said cleaning element whereby edges of the fan blade are cleaned while simultaneously cleaning a top and bottom surface of the fan blade.

5. The fan blade cleaning tool as in claim 4 wherein said horizontally disposed surfaces include a material having fibers protruding therefrom affixed thereto for gently cleaning and capturing the debris when said cleaning element engages the fan blade.

6. The fan blade cleaning tool as in claim 4 wherein said shoulders are tapered generally inwardly from said front wall towards said back wall.

7. The fan blade cleaning tool as in claim 4 wherein said shoulders are substantially flat a predetermined distance from respective said side walls and terminate in smooth reduced edges merging with respective said top and bottom walls.

8. A fan blade cleaning tool comprising a housing, a cleaning element removably mounted in said housing, said element having interior surfaces defining a centrally disposed passageway aligned to frictionally engage an outer surface of a fan blade for removing debris therefrom, and a handle affixed to said housing for moving said cleaning element over the length of the fan blade whereby substantially the entire fan blade is cleaned, said element being formed from a deformably resilient material with said passageway extending from an inlet end portion to an exit end portion, said inlet end portion being vertically and horizontally tapered from a wide open inlet end to an interior location in which the vertical tapering is terminated, and said passageway being tapered only in the horizontal direction from the interior location to its exit end portion.

9. A fan blade cleaning tool comprising a housing, a cleaning element removably mounted in said housing, said element having interior surfaces defining a centrally disposed passageway aligned to frictionally engage an outer surface of a fan blade for removing debris therefrom, and a handle affixed to said housing for moving said cleaning element over the length of the fan blade whereby substantially the entire fan blade is cleaned, the centrally disposed passageway including an inlet comprising a pair of oppositely disposed trapezoidal surfaces wherein the first said surface is declined rearwardly from a horizontal plane and the second said surface is inclined rearwardly from a horizontal plane, and a pair of oppositely-disposed trapezoidal upright walls connected longitudinally along their respective upper and lower edges to the said trapezoidal surfaces.

10. A fan blade cleaning tool comprising a housing, a cleaning element removably mounted in said housing, said element having interior surfaces defining a centrally disposed passageway aligned to frictionally engage an outer surface of a fan blade for removing debris therefrom, and a handle affixed to said housing for moving said cleaning element over the length of the fan blade whereby substantially the entire fan blade is cleaned, said cleaning element having an outside surface and being formed from a deformably resilient material with said passageway extending therethrough between an inlet and an outlet, said passageway including a top wall, a bottom wall and two pair of spaced side walls, said bottom and top walls tapering vertically and one pair of said side walls tapering horizontally to form a substantially wide open inlet adjacent said outside surface, the other of said pair of side walls extending horizontally toward each other to said outlet and forming with said top and bottom walls the remaining portion of said passageway.

11. The fan blade cleaning tool as in claim 10 wherein a material having fibers protruding therefrom is affixed to the internal surfaces defining said passageway for gently cleaning and capturing the debris when said cleaning element engages the fan blade.

12. A fan blade cleaning tool comprising a housing having front, rear, top, bottom, and side walls integrally affixed together to form a closed shell having openings only in the front and rear walls, the openings comprising an open entrance in the front wall and an open exit in the rear wall, a cleaning element removably secured within said housing, said element having a pair of horizontally disposed surfaces substantially in superposition to frictionally engage the surface of a fan blade for removing debris therefrom, and a handle affixed to said housing for moving the cleaning element over the length of the fan blade whereby substantially the entire fan blade is cleaned, said cleaning element having an inlet end portion and an exit end portion, said inlet end portion being vertically tapered from a wide open inlet to an interior in which the vertical tapering is terminated.

13. A fan blade cleaning tool comprising a housing having front, rear, top, bottom, and side walls integrally affixed together to form a closed shell having openings only in the front and rear walls, the openings comprising an open entrance in the front wall and an open exit in the rear wall, a cleaning element removably secured within said housing, said element having a pair of horizontalaly disposed surfaces substantially in superposition to frictionally engage the surface of a fan blade for removing debris therefrom, and a handle affixed to said housing for moving the cleaning element over the length of the fan blade whereby substantially the entire fan blade is cleaned, said cleaning element including a passageway between said pair of surfaces for permitting the passage of the fan blade therethrough, said cleaning element having an open inlet tapering vertically toward said passageway and communicating therewith.

14. A fan blade cleaning tool as in claim 13 wherein said passageway tapers horizontally toward said exit.

15. A fan blade cleaning tool as in claim 14 wherein said cleaning element is formed from deformably resilient material to permit compression thereof to be loaded in said housing and thereafter expanding to substantially fill said housing to remain secure therein during use thereof.

16. A fan blade cleaning tool comprising an enclosed housing having front, rear, top, bottom, and side walls integrally affixed together to form a closed shell having openings only in the front and rear walls, the opening comprising an open entrance in the front wall and an open exit in the rear wall in longitudinal alignment, a cleaning element removably mounted in said housing, said element having at least a pair of generally planar interior surfaces defining a centrally disposed passageway aligned to simultaneously and frictionally engage outer surfaces and both elongated side edges of a fan blade for removing debris therefrom, and a handle affixed to said housing for moving said cleaning element over the length of the fan blade whereby substantially the entire fan blade is cleaned by a single reciprocating pass longitudinally onto and off the fan blade.

17. A fan blade cleaning tool as in claim 16 wherein said handle is affixed to said housing at an angle to dispose the lower part of the handle outwardly of said cleaning element to allow the user to clean the fan blade with said tool while standing aside from the fan blade being cleaned.

18. A fan blade cleaning tool as in claim 17 wherein said handle is comprised of a rod having one end threadably attached to said bottom wall of said housing.

19. The tool as in claim 16 wherein the centrally disposed passageway has a decreasing transverse width from its inlet to its outlet.

20. The fan blade cleaning tool as in claim 16 wherein a material having fibers protruding therefrom is affixed to said interior surfaces defining said passageway for gently cleaning and capturing the debris when said cleaning element engages the fan blade.

21. The fan blade cleaning tool as in claim 16, wherein said housing has substantially continuous shoulders directed inwardly from said top and bottom walls for containing and securing said cleaning element therein.

22. The fan blade cleaning tool as in claim 21 wherein said cleaning element is formed of a material having sufficient resiliency to allow said element to be loaded in said housing through said open entrance or said open exit and remain secured therein.

23. A fan blade cleaning tool comprising an enclosed housing having front, rear, top, bottom, and side walls integrally affixed together to form a closed shell having openings only in the front and rear walls, the openings comprising an open entrance in the front wall and an open exit in the rear wall in longitudinally alignment, a cleaning element removably secured within said housing, said element having at least a pair of generally horizontally disposed planar surfaces substantially in superposition to simultaneously and frictionally engage the outer surfaces and both elongated side edges of a fan blade for removing debris therefrom, and a handle affixed to said housing for moving the cleaning element over the length of the fan blade whereby substantially the entire fan blade is cleaned by a single reciprocating pass longitudinally onto and off the fan blade.

24. A fan blade cleaning tool as in claim 23 wherein said cleaning element is comprised of a deformably resilient material having sufficient resiliency to allow said element to be loaded in said housing and remain secured therein.

25. A fan blade cleaning tool as in claim 23 wherein said housing has substantially continuous shoulders directed inwardly from said top and bottom walls for containing and securing said cleaning element therein.

26. A fan blade cleaning tool as in claim 23 wherein said cleaning element is formed from a deformably resilient material so that when the fan blade is placed between said pair of horizontally disposes surfaces a collapsible passageway is formed for frictionally engaging surfaces of the fan blade.

* * * * *